US006691383B2

(12) United States Patent
Linton

(10) Patent No.: US 6,691,383 B2
(45) Date of Patent: Feb. 17, 2004

(54) WEBLESS ZIPPER

(75) Inventor: Basil Linton, Loganville, GA (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 10/093,238

(22) Filed: Mar. 7, 2002

(65) Prior Publication Data

US 2003/0167607 A1 Sep. 11, 2003

(51) Int. Cl.[7] ..... B65D 33/16

(52) U.S. Cl. ..... 24/585.12; 24/30.5 R; 24/400; 383/63; 156/66

(58) Field of Search ..... 24/399, 400, 30.5 P, 24/30.5 R, 389, 587, 575–577, 585.12; 383/63, 65; 156/66

(56) References Cited

U.S. PATENT DOCUMENTS

| | | | | | |
|---|---|---|---|---|---|
| 4,736,451 | A | | 4/1988 | Ausnit | |
| 4,907,321 | A | * | 3/1990 | Williams | 24/585.12 |
| 5,012,561 | A | * | 5/1991 | Porchia et al. | 24/585.12 |
| 5,689,866 | A | * | 11/1997 | Kasai et al. | 24/585.12 |
| 5,904,425 | A | * | 5/1999 | May | 383/203 |
| 5,983,466 | A | * | 11/1999 | Petkovsek | 24/400 |
| 6,004,032 | A | * | 12/1999 | Kapperman et al. | 383/5 |
| 6,009,603 | A | * | 1/2000 | Gallagher | 24/585.12 |
| 6,014,795 | A | * | 1/2000 | McMahon et al. | 24/400 |
| 6,112,374 | A | * | 9/2000 | Van Erden | 24/400 |
| 6,138,329 | A | * | 10/2000 | Johnson | 24/584.1 |
| 6,167,597 | B1 | * | 1/2001 | Malin | 24/585.1 |
| 6,386,760 | B1 | * | 5/2002 | Tomic | 383/5 |

FOREIGN PATENT DOCUMENTS

| | | | |
|---|---|---|---|
| DE | 0515985 | A1 * | 12/1992 |
| EP | 0 666 041 | | 9/1995 |
| EP | 0 836 814 | | 4/1998 |
| EP | 0 384 588 | | 8/1999 |
| EP | 1 033 317 | | 6/2000 |

* cited by examiner

*Primary Examiner*—Anthony Knight
*Assistant Examiner*—André L. Jackson
(74) *Attorney, Agent, or Firm*—Pitney, Hardin, Kipp & Szuch LLP

(57) ABSTRACT

A zipper (10) having interlocking profiles (16, 20) wherein the male profile (16) has at least two male ribs (26, 30) bordering a male rib (28). The male profile (16) is engagable with a female profile (20), wherein the female profile (20) includes grooves (38, 48). The grooves (38, 48), attached to each other by a bridge (54), engage the male ribs (26, 32). With the profiles (16, 20) engaged, the male rib (28) pushes against the bridge (54) and thereby pushes the bridge against the packaging film during attachment such that the profiles (16, 20) are stabilized during sealing to the packaging film. As part of a pre-made zipper (10), the male rib (28) can be attached to the bridge (54) to form a barrier seal within the zipper (10).

11 Claims, 3 Drawing Sheets

WEBLESS ZIPPER

FIELD OF THE INVENTION

The present invention relates to improvements in flexible continuous plastic zippers of the rib and groove type in which the ribs of one profile and the grooves of another profile engage when pressed together and release when pulled apart so as to form a reclosable zipper. More specifically, the present invention relates to a zipper in which the interlocking profiles themselves may be stably sealed to the packaging film of a reclosable bag thereby eliminating the need for flanges or webs as sealing areas to the packaging film. As part of the zipper, a male rib of one of the profiles can be attached to an opposing profile to form a barrier seal within the zipper.

DESCRIPTION OF THE PRIOR ART

The present invention relates to improvements in the package making art and may be practiced in the manufacture of reclosable thermoplastic bags and packages of the kind that may be used for various consumer products. Such packages often include a form of barrier seal to render the pack moistured and/or airtight prior to an initial opening of the package. A zipper with interlocking profiles protects any remainder of the product therein after the initial opening.

The prior art for zippers with interlocking profiles is fairly well developed but nevertheless remains open to improvements, specifically those which contribute to a reduction of material used in the manufacturing process. In the prior art, zippers require flanges (webs) in order to attach to the packaging film used to make a reclosable bag. In a typical sealing or attachment operation, the zipper flanges provide stability for the zipper profiles by preventing the profiles from curling in shape or contracting when heat or pressure is applied by a sealing device. An improvement to existing zippers would be to provide a zipper that does not require flanges to support the attachment of the zipper profiles in a vertical form, fill and seal (VFFS) bag making machine or other bag making machines. Without the need for flanges, the material required for the zipper and the zipper area will be reduced. With a reduced zipper area, the headspace on the packaging film required for zipper attachment will be reduced, thereby reducing the amount of packaging film required to produce the reclosable bag.

The hermetic or barrier seals of the prior art must typically be opened in order to access the zipper. The seals are positioned adjacent to the zipper and are not part of the zipper itself. An additional improvement to existing zippers would be to provide a barrier seal as part of the interlocking profiles of the zipper. An internal seal would eliminate the need for the peel sealable or barrier seal area adjacent to the zipper; thereby further reducing the amount of packaging film required to produce the reclosable bag.

SUMMARY OF THE INVENTION

Accordingly, the present invention eliminates the need for attachment flanges by improving the shape of the interlocking male and female profiles of the zipper. The improved shape comprises a male profile with at least three male ribs with two of the ribs having a double-barbed end and with the double-barbed male ribs bordering a male rib that can have but does not require a barbed end.

The female profile, which engages with the male profile, also has a plurality of male ribs. The plurality of male ribs forms two grooves, which securely interlock the double-barbed male ribs of the male profile. A bridge attaches the grooves of the female profile to each other. When the profiles are engaged and are being attached to packaging film, the end of the bordered male rib of the male profile pushes against the facing bridge and thereby pushes the bridge against the packaging film. The pressure by the bordered male rib on the bridge prevents the groove areas from curling toward each other and/or contracting during the sealing or attachment operation. Simultaneously, the bordered male rib presses against the male profile such that the bordering male ribs are prevented from curling or deforming. As a result of this pressure, a greater backing area of the male profile and the female profile can be sealed to the packaging film used to form a reclosable bag. With a greater sealed area of the profiles, the need for a backing web or flange is eliminated.

Additionally the bordered rib of the male profile may provide a barrier seal feature, wherein the end of the rib is sealed to the bridge of the female profile. An area of weakness would be provided along the bordered rib. During an opening of the zipper, the area of weakness is broken thereby providing access to the contents of the reclosable bag.

DESCRIPTION OF THE DRAWINGS

Further objects and advantages of the invention will become apparent from the following description and claims and from the accompanying drawings, wherein:

DETAILED DESCRIPTION OF THE PREFERRED EMBODIMENT

Figure 1:
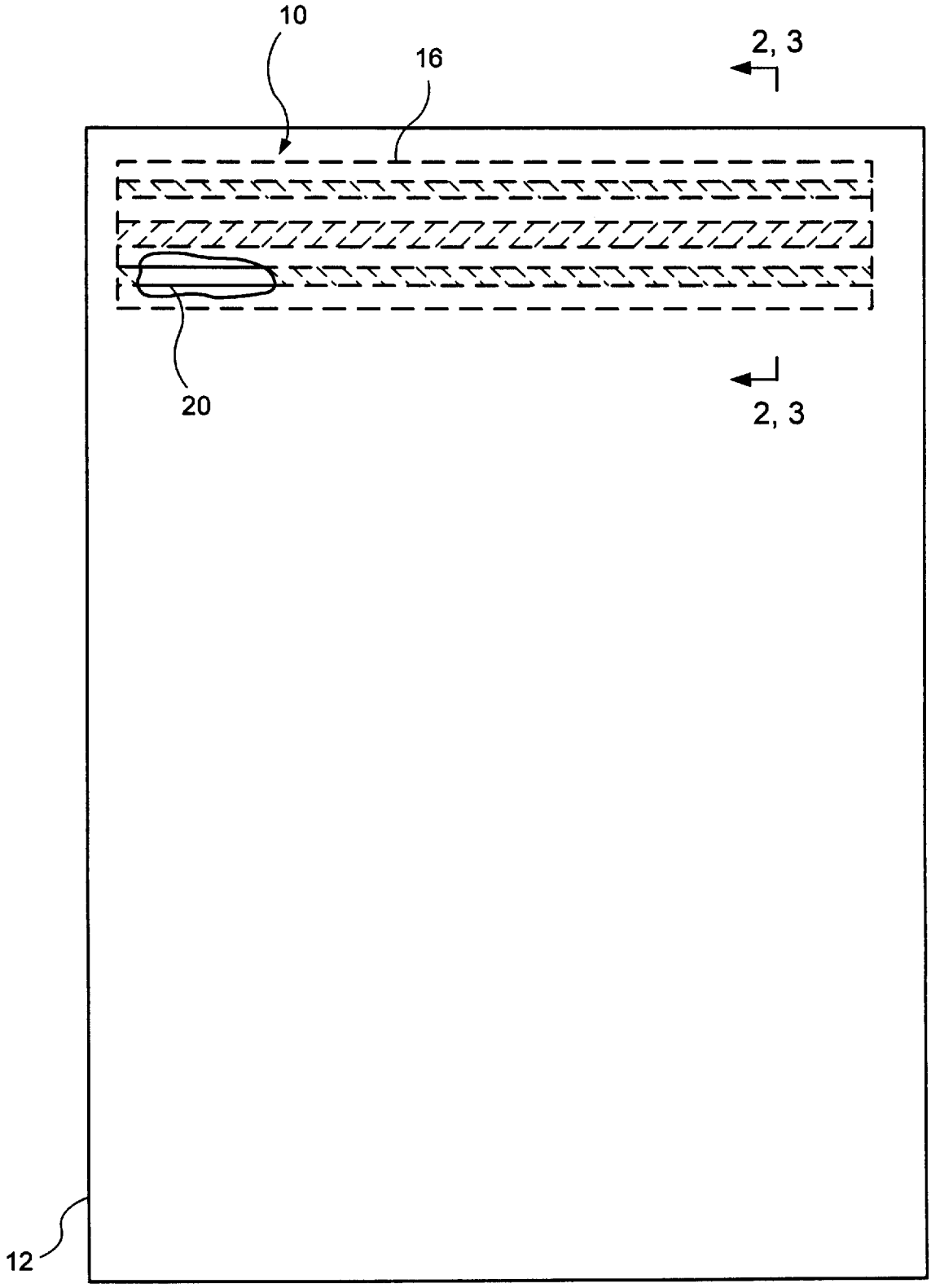
FIG. 1 is a front view of a zipper of the present invention attached to a reclosable bag.

Referring now to the drawings in detail wherein like numerals indicate like elements throughout the several views, a webless zipper 10 attached to a reclosable bag 12 is shown in FIG. 1. An interlocking male profile 16 and an interlocking female profile 20 are also shown as covering the length of the zipper 10. The width of the zipper is preferably between fourteen hundredths of an inch and a quarter of an inch; however, the width of the zipper 10 can vary depending on the application, as would be apparent to those skilled in the art.

Figure 2:
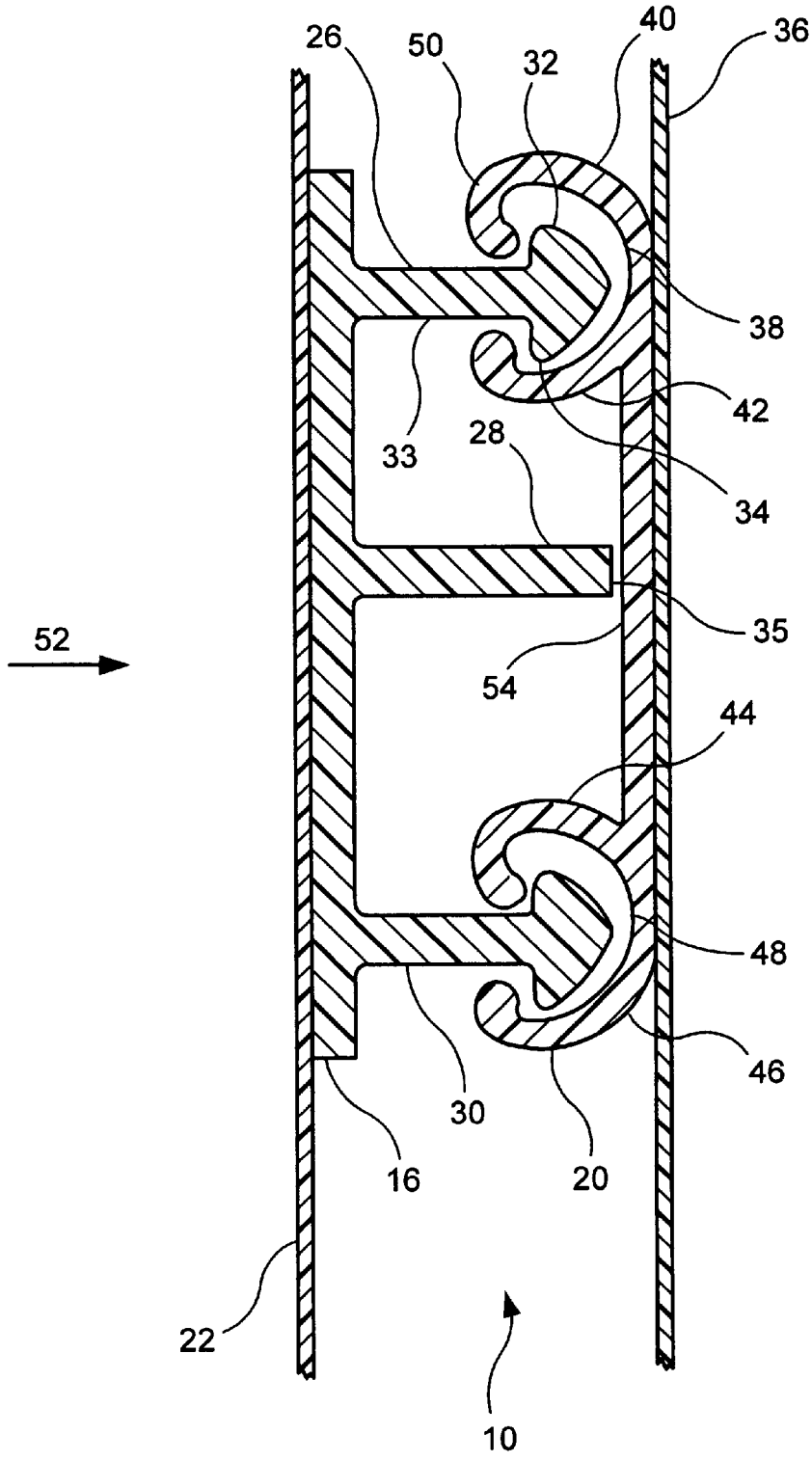
FIG. 2 is a cross-sectional view of the zipper with the interlocking male and female profiles of the zipper engaged and taken from reference line 2—2 of FIG. 1.

In FIG. 2, the male profile 16 is engaged with the female profile 20. In the figure, the contact areas of the profiles are shown as slightly separated in order to distinguish the shape of each profile. The male profile 16 is a resiliently flexible profile attached to a side 22 of the reclosable bag 12. The male profile 16 includes three male ribs 26, 28 and 30 with the male ribs 26 and 30 having double-barbed end sections at the end of the shaft of each male member (illustrated as an end section 32 for a shaft 33 of the male rib 26). The barbs of each end section are asymmetrical with a longer barb (illustrated as barb 34 for the end section 32) facing the product side of the reclosable bag 12 and with the longer barb requiring a greater opening force for the product side of the reclosable bag 12.

The male ribs 26 and 30 border the slightly longer male rib 28. The bordered male rib 28 preferably includes a blunt end 35 shown; however, the male rib may further include flattened protrusions extending perpendicular to sides of the rib or the male rib may include any other end configuration as would be apparent to those skilled in the art. The number of bordered male ribs may increase based on the size of the zipper.

The female profile 20 is a resiliently flexible profile facing opposite the male profile 16. The female profile 20 is attached to a second side 36 of the reclosable bag. The female profile 20 includes two grooves with the first groove 38 formed by male ribs 40 and 42. Male ribs 44 and 46 form the second groove 48. The male ribs of the female profile 20 are each formed with a single-barbed end section (illustrated as an end section 50 for the male rib 44). The single-barbed end sections, which face inward to the well of each groove, secure the barbed male ribs 26 and 30 of the male profile 16. The number and shape of the ribs can vary depending on the application, as would be apparent to those skilled in the art.

For engaging the male profile 16 and the female profile 20, the profiles are pressed together. In the engagement, the male ribs 26 and 30 of the male profile 16 secure respectively in the grooves 38 and 48 of the female profile 20. The male rib 28 of the male profile 16 presses in direction 52 against a bridge 54 of the female profile 20. The bridge 54 connects the grooves 38 and 48 and provides support for both.

When the male rib 28 is pressed against the bridge 54 during a sealing operation, the male rib stabilizes the bridge. Once stabilized, the bridge 54 prevents the grooves 38 and 48 from curling or deforming. Simultaneously, the male rib 28 is pressured against the male profile 16 such that the male ribs 26 and 30 are prevented from curling or deforming. As a result of the stabilization of both profiles, a greater backing area of the male profile 16 and the female profile 20 can be respectively sealed to the sides 22 and 36. With a greater sealed area of the profiles, the need for a backing web or flange is eliminated.

Figure 3:
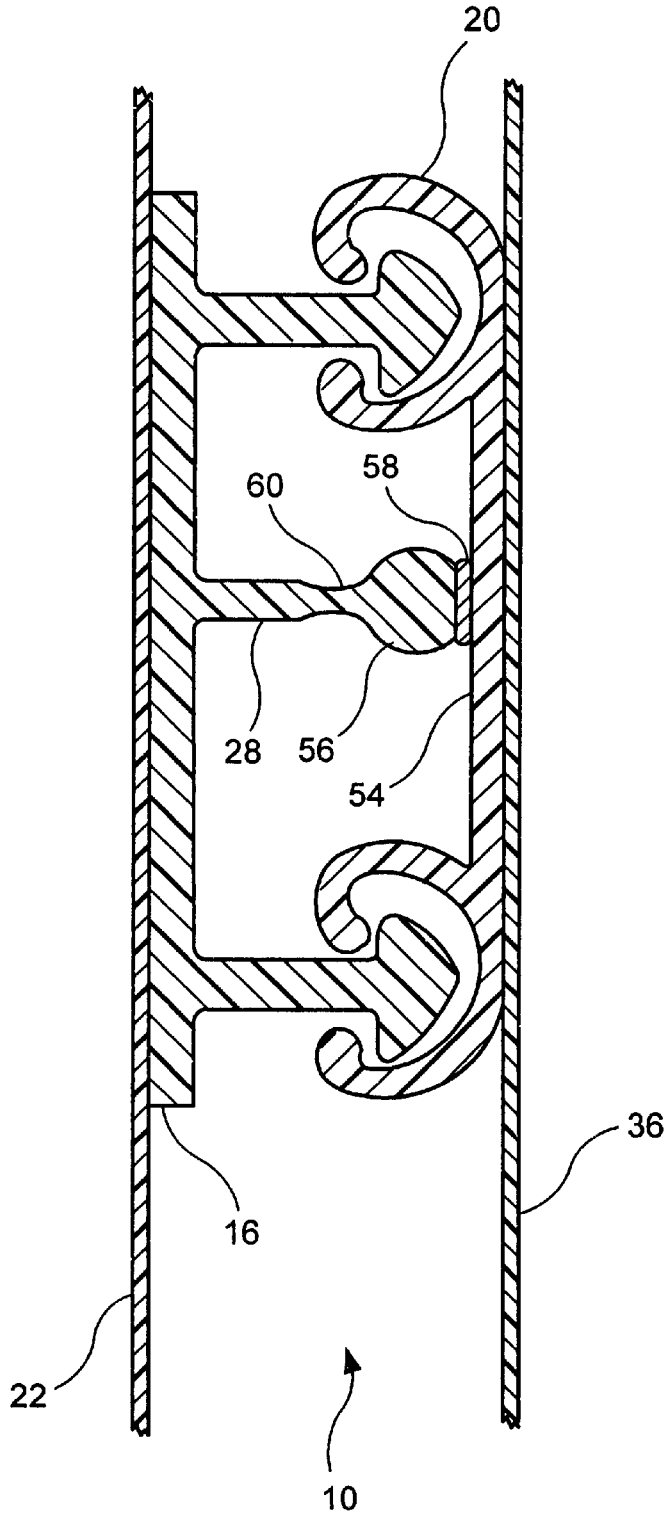
FIG. 3 is a cross-sectional view of the zipper with the male profile of the zipper, including a ball-ended male rib, engaged with the female profile of the zipper and taken from reference line 3—3 of FIG. 1.

FIG. 3 depicts the bordered male rib 28 of the zipper 10 acting as a barrier seal. In the figure, the male profile 16 is similarly engaged with the female profile 20. The male rib 28 includes a ball end 56. As part of the pre-made zipper 10, the ball end 56 is attached to the bridge 54 at seal 58. As the profiles of the zipper are sealed to the packaging film of the reclosable bag 12, the male rib 28 still provides pressure against the bridge. When the bag is opened, a weakened area 60 adjacent to the ball end is broken through while the seal 58 still adheres to the bridge 54, thereby localizing the breakage point within the zipper 10. The weakened area 60 would have a smaller cross-sectional area than the male rib 28; however, the type of weakened area can vary depending on the application as would be apparent to those skilled in the art.

Thus the several aforementioned objects and advantages are most effectively attained. Although preferred embodiments of the invention have been disclosed and described in detail herein, it should be understood that this invention is in no sense limited thereby and its scope is to be determined by that of the appended claims.

What is claimed is:

1. A reclosable bag formed from a bag-making film and having opposed film walls, a bottom and a top, said reclosable bag including:

a first interlockable profile having a longitudinally extending locking portion with said locking portion of the first profile sealed along the top of a first of the film walls, said locking portion having at least two continuous spaced apart interlockable members extending along a base with a stabilizing rib therebetween said stabilizing rib includes an area of weakness;

a second interlockable profile having a longitudinally extending locking portion with said locking portion of the second profile sealed along the top of a second of the film walls, said locking portion of the second interlockable profile having at least two spaced continuous interlockable members therealong separated by a bridge portion, the interlockable members of the second profile being engageable with the interlockable members of the first profile;

wherein said stabilizing rib is at least initially sealed to said bridge portion; and wherein a distal end of said stabilizing rib is formed as a ball, and said area of weakness is between said ball and said base.

2. The reclosable bag in accordance with claim 1 wherein said two continuous spaced apart interlockable members of the first interlockable profile have the same configuration and the two interlockable members of the second interlockable profile have the same configuration.

3. The reclosable bag of claim 1 wherein said stabilizing rib includes an area of weakness which ruptures during an initial opening of the zipper.

4. The reclosable bag in accordance with claim 1 wherein said two continuous interlockable members of said first profile are male members.

5. The reclosable bag in accordance with claim 4 wherein said locking portion of said male members comprise a shaft having barbs extending laterally at each side of a free end of said shaft.

6. A zipper comprising:

a first interlockable profile having a longitudinally extending locking portion, said locking portion having at least two continuous spaced apart interlockable members extending along a base with a stabilizing rib therebetween;

a second interlockable profile having a longitudinally extending locking portion, said locking portion of the second interlockable profile having at least two spaced continuous interlockable members therealong separated by a bridge portion, the interlockable members of the second profile being engageable with the interlockable members of the first profile;

wherein said stabilizing rib is at least initially sealed to said bridge portion and said two continuous interlockable members of said first profile are engaged with said two interlockable members of said second profile; and wherein said stabilizing rib includes protrusions extending laterally at each side of a distal end of said stabilizing rib, said protrusions and said distal end being contactable with said bridge.

7. The zipper in accordance with claim 6 wherein said two continuous spaced apart interlockable members of the first interlockable profile have the same configuration and the two interlockable members of the second interlockable profile have the same configuration.

8. The zipper in accordance with claim 6, wherein said stabilizing rib further includes an area of weakness which ruptures during an initial opening of the zipper.

9. The zipper in accordance with claim 6 wherein said two continuous interlockable members of said first profile are male members.

10. The zipper in accordance with claim 9 wherein said locking portion of said male members comprise a shaft having barbs extending laterally at each side of a free end of said shaft.

11. A zipper comprising:

a first interlockable profile having a longitudinally extending locking portion, said locking portion having at least two continuous spaced apart interlockable members extending along a base with a stabilizing rib therebetween said stabilizing rib includes an area of weakness;

a second interlockable profile having a longitudinally extending locking portion, said locking portion of the second interlockable profile having at least two spaced continuous interlockable members therealong separated by a bridge portion, the interlockable members of the second profile being engageable with the interlockable members of the first profile;

wherein said stabilizing rib is at least initially sealed to said bridge portion and said two continuous interlockable members of said first profile are engaged with said two interlockable members of said second profile;

wherein a distal end of said stabilizing rib is formed as a ball, and said area of weakness is between said ball and said base.

* * * * *